United States Patent [19]

Vollmar

[11] 4,050,839

[45] Sept. 27, 1977

[54] PROCESS FOR RAISING MANHOLES

[76] Inventor: Ronald D. Vollmar, 1809 Clark St., Muncie, Ind. 47301

[21] Appl. No.: 718,125

[22] Filed: Aug. 27, 1976

[51] Int. Cl.[2] ..... E03F 1/00; E02D 29/14

[52] U.S. Cl. ..... 404/72; 52/21; 210/163; 404/26

[58] Field of Search ..... 404/72, 25, 26; 52/21; 210/163, 166, 459, 473

[56] References Cited

U.S. PATENT DOCUMENTS

| | | | |
|---|---|---|---|
| 1,852,928 | 4/1932 | Helling | 404/26 |
| 2,166,632 | 7/1939 | Hardesty | 52/21 |
| 3,250,190 | 5/1966 | Taylor | 404/25 |
| 3,695,153 | 10/1972 | Dorris | 52/21 X |
| 3,891,337 | 6/1975 | McCoy | 404/26 |
| 3,968,600 | 7/1976 | Bowman | 404/26 X |

*Primary Examiner*—Nile C. Byers
*Attorney, Agent, or Firm*—Wallace E. Weakley

[57] ABSTRACT

A process for raising manholes and manhole covers to a new grade level of a street when constructing new streets or when paving old streets, comprising the steps of placing a sealing means around the interior of the cast manhole between the lower edge thereof and the upper edge of a sewer catch basin, and pouring wet concrete around the exterior of manhole, the sealing means, and the upper edge of the sewer catch basin to form a continuous joint between the manhole at the raised grade level and the upper edge of the sewer catch basin, and removing the sealing means from between the edges of the manhole and sewer catch basin.

1 Claim, 3 Drawing Figures

PROCESS FOR RAISING MANHOLES

BACKGROUND OF THE INVENTION

1. Field of the Invention

This invention relates to a process and method of raising manholes in sewer construction and street and highway resurfacing projects, and more specifically, to a process for obtaining a complete seal between the raised manhole and the upper edge of a sewer catch basin opening when a manhole is raised to a new grade level required by street repaving or installation of a new street or sewer catch basin.

2. Description of the Prior Art

Municipal governments are responsible for thousands of dollars in property damage and personal injuries suffered as a result of improperly installed or improperly maintained manholes, which provide access to municipal storm and sanitary sewers, and to public utilities. Improperly installed or maintained cast manhole frames cause damage to automobiles and bicycles and are sources of legal headaches for many administrators and elected officials of a municipal government.

Improperly installed or maintained manholes are also costly to the tax payer, in that such improperly installed or maintained manholes allow excessive amounts of surface and sub-surface water to flow into the storm and sanitary sewers of a city, resulting in additional costs for wastewater treatment facilities for handling the excessive water flow entering the system through the improperly installed or maintained manholes.

Improperly installed or maintained manholes are today costing many communities considerable additional expenses, which would be unnecessary if the storm and sanitary manholes were properly installed and maintained. This increase in costs of operation of storm and sanitary sewage systems is especially important today with the new Environmental Protection Agency (E.P.A.) regulations that now require Inflow-/Infiltration (I/I) and Sewer System Evaluation Surveys (S.S.E.S.) to be made by municipal governments on municipal storm and sewage treatment facilities.

In the ideal situation, all manholes in a storm or sanitary system should be functional, because they are the only access point to the interior of the storm or sanitary sewer system. A properly constructed and maintained manhole must have its lid level with the surface of the street or ground. This keeps the manhole accessible, so that inspections and repairs are easily made, thereby adding to public safety.

In addition, a manhole must be accessible in order to maintain the manhole and sewer system and meter the flow there through.

However, many manholes are not functional, nor are they accessible. Many are buried under asphalt, gravel or sidewalks in a city. Other manholes have not been adjusted to the proper grade level as new layers of asphalt or concrete have been placed on the surface of a street. Such improper maintenance of a manhole results in a bump or a hole in the road pavement.

The solution to these problems is to readjust the manhole frames to the proper grade of the street. Such readjusting of the manhole frames to the proper grade level of the street is presently done by cutting away the pavement around the manhole frame and removing the subsoil from around the manhole frame and the upper surface of the sewer catch basin.

The cast manhole frame is then raised and shimmed to the proper level by placing bricks at three equidistant points around the circumference of the manhole frame. The space between the bottom edge of the manhole frame and the upper edge of the catch basin opening is then filled with bricks, which are, in turn, mortared together, at their joints. Such a process is very time consuming, in that the bricks must be put in place one at a time by hand, and the joints must be thoroughly mortared in order to prevent leakage between the manhole frame and the sewer catch basin.

The exterior surface of the brick and mortar collar must also be sealed to strengthen the collar and prevent the bricks from caving in from exterior pressure from the subsurface dirt, water and surface paving.

Another method has been developed in an effort to save labor costs in raising a manhole frame to the proper grade. This process incorporates the standard method of leveling the manhole frame by placing bricks at three points equidistant around the circumference of the frame to obtain the proper grade level. However, instead of bricking the space between the manhole frame and the top of the catch basin by hand, thick concrete is poured around the exterior of the manhole frame and upper edge of the sewer catch basin. The concrete is of a sufficiently thick consistency, so as to prevent it from readily flowing into the open space between the manhole frame and the sewer catch basin. However, at least one man is required to try to keep the concrete from flowing into the interior of the catch basin. This, of course, is not very successful, as the concrete will drop away from the vertical surface and fall into the interior of the catch basin. Furthermore, a very irregular, uneven interior surface results from this method, which is totally unsatisfactory.

A third, less used method, is to use precast concrete rings instead of bricks to close the space between the upper surface of the sewer catch basin and the lower edge of the manhole frame. However, this method is very expensive, and creates many problems with regard to the leveling of the manhole frame. Furthermore, the precast concrete rings are available only in certain sizes and, thus, do not lend themselves to every application.

Summary of the Invention

The present invention reduces the labor and material costs incurred in the raising of a manhole frame relative to a sewer catch basin to a new grade required by the installation or repaving of a street surface, by incorporating a simple sealing process in conjunction with flowing material such as concrete, asphalt, or the like to achieve a proper seal between the manhole frame and the sewer catch basin surface.

The present invention eliminates the time consuming, expensive method of hand laying individual bricks between the upper edge of a sewer catch basin opening and the bottom edge of a manhole frame, and further eliminates the requirement of hand mortaring the joints between the bricks, presently required to obtain a satisfactory seal between the manhole frame and the catch basin opening.

The present invention further presents a method that is easy to use, is inexpensive, and results in a neater appearing, stronger and tighter sealed manhole-catch basin-casting joint than can be achieved by the present methods.

The present invention further presents an advantage in that it is adaptable to all sizes and shapes of manhole covers and sewer catch basin openings, and can be used to achieve an accurate positioning of the manhole frame relative to the proper grade level.

These and other advantages of the present invention will been seen upon reading the following specification and viewing the drawings, which form a part of this application.

DESCRIPTION OF THE PREFERRED EMBODIMENTS

Figure 1:
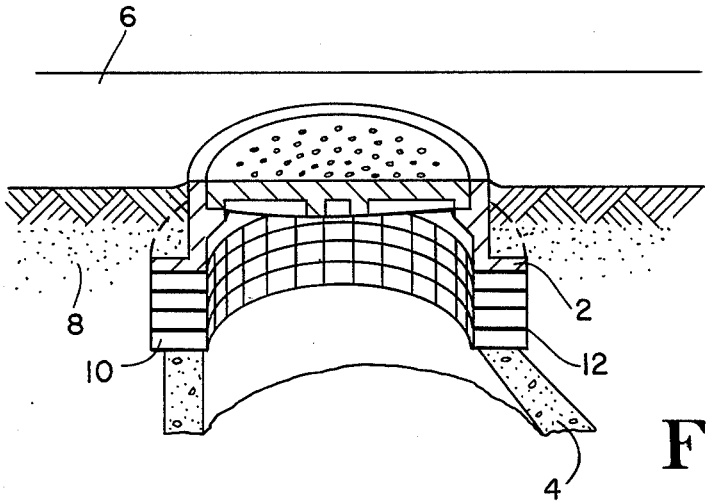
Fig. 1 Prior Art
FIG. 1 is a cross-section view of a sewer catch basin and manhole frame installation showing the present method of raising the manhole frame to a new grade level and obtaining a seal between the manhole frame and the sewer catch basin opening surface.

The preferred embodiments of the present invention will now be described with reference to the accompanying drawings. As shown in FIG. 1, it often becomes necessary to raise a manhole frame 2, which is formed of cast iron, or other similar material, relative to the opening in a sewer catch basin 4, inorder to place the manhole frame 2 at a proper grade level for the purpose of installing a new road bed or repaving a road surface 6.

In order to obtain the proper grade level for the manhole frame 2, the manhole frame 2 is shimmed to the proper grade level by placing bricks 10 at three places equidistant around the circumference of the manhole frame 2. When the proper grade level and proper leveling of the manhole frame 2 is obtained by the shimming of the frame 2 by means of bricks 10, the remaining area between the bottom surface of the manhole frame 2 and the opening in the sewer catch basin 4 is bricked up by hand. This requires a laborer to climb down into the interior of the sewer catch basin 4 and place individual bricks 10 by hand into the space between the manhole frame 2 and the sewer catch basin 4. As the laborer places the bricks 10 into the space, he must properly mortar the bricks to obtain proper sealing in the motar joints 12 between each row and each side of the bricks 10.

After the space between the manhole frame 2 and the sewer catch basin 4 has been laboriously bricked in by hand by placing bricks 10 and mortar 12 therein, the subsoil 8 is replaced around the sewer catch basin 4 and the manhole frame 2 and is graded to the proper level. The new or the new roadway surface pavement 6, which may be concrete, blacktop, or other suitable material, is then placed on the subsoil 8 and leveled to the proper grade level.

If the bricks 10 and mortar joints 12 are not placed properly, leakage of subsurface water from the subsoil 8 into the interior of the catch basin 4 will occur, which will result in an excessive amount of flow through the catch basin and sewer system. In order to prevent such leakage, it often becomes necessary to mortar up not only the interior surface of the bricks 10, but also the exterior surfaces thereof, which requires additional time and effort, thereby resulting in high labor costs.

The specific steps of the preferred embodiments of the present invention will now be described with reference to FIGS. 2 and 3 of the drawings. When it becomes necessary to raise the grade level of a manhole frame 2 relative to the opening of a sewer catch basin 4, the subsoil dirt 8 is removed from around the manhole frame 2 and sewer catch basin 4. The manhole frame 2 is then shimmed to the proper grade level in the same manner as the present manhole raising methods. Bricks 10 are placed in three locations equidistant around the circumference of the manhole frame 2 and the opening into the sewer catch basin 4, and the manhole cover 2 is shimmed and adjusted to the proper grade level and position. After the manhole frame 2 has been properly positioned, an expandable device, such as a tire inner tube or expanding ring 14, shown in FIG. 2, or an expandable cylindrical ring or collar 15, having a device for expanding the diameter thereof, is placed within the space within the manhole frame 2 and the opening of the sewer catch basin 4, The expandable means, or inner tube 14, is then inflated to cause it to engage the interior edge of both the manhole frame 2 and the sewer catch basin 4, as shown in FIG. 2.

Figure 2:
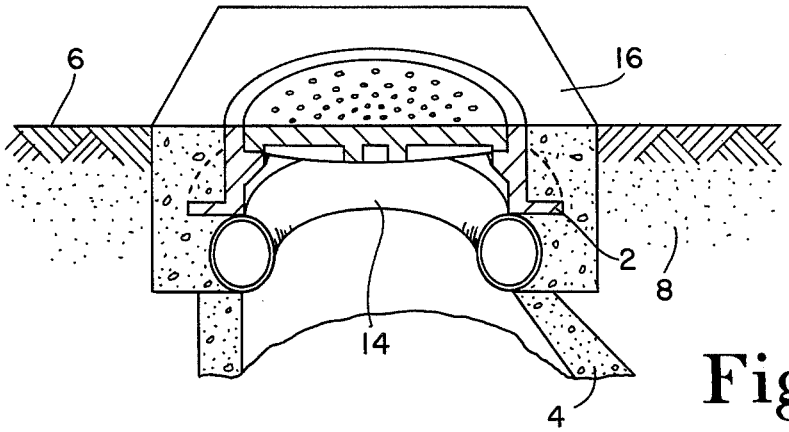
FIG. 2 is a vertical cross-sectional view of a sewer catch basin and manhole frame installation utilizing one embodiment of the present invention to obtain the proper sealing between the manhole frame and the catch basin.

After the expanding means, or inner tube 14 is inflated and is in place, as shown in FIG. 2, wet concrete 16 is then poured around the expanded inner tube, where it flows into the space and voids between the inner tube and the bottom of the manhole frame 2, the top surface of the opening of the sewer catch basin 4, and down around the side of the sewer catch basin 4. Sufficient concrete 16 is poured around the side of the inflated inner tube 14 and the manhole frame 2 to form a square or rectangular pad around the manhole frame 2. The concrete is tapered away from the lid by the operator to reduce expensive infiltration of rain water into the sanitary system. In the alternative, a storm sewer manhole can be adjusted slightly below grade when surface water collection is desirable.

As the concrete 16 flows around the inflated inner tube 14, the pressure of the flowing concrete forces the outer curved surfaces of the inner tube inward, thereby resulting in a straight, smooth surface for the concrete. In addition, the concrete 16 seals against the surface of the sewer catch basin 4 around the opening there through and against the bottom surface of the manhole frame 2, resulting in a water tight seal, thereby preventing penetration and excess collection of sub-surface ground water into the sewer system. In addition, the interior of the manhole is smooth and no jagged edges are left to injure mantenance crews. Furthermore, no debris falls into the sewer when the process according to the subject invention is used.

Figure 3:
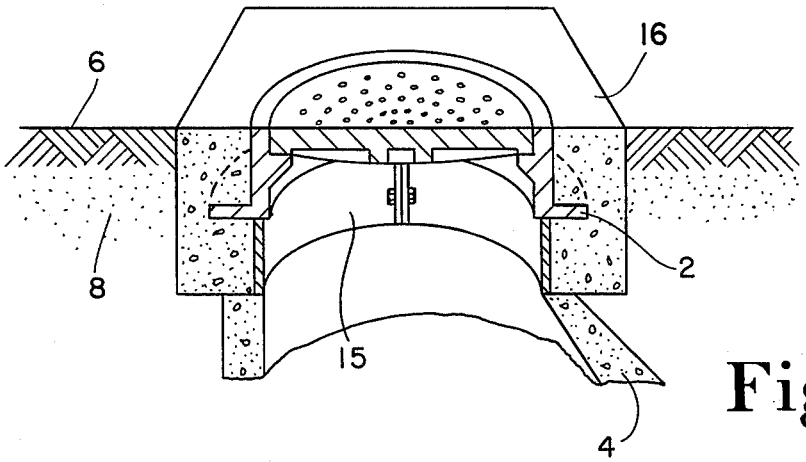
FIG. 3 is a further vertical cross-section view of a sewer catch basin and manhole cover installation employing a further embodiment of the present invention to obtain the seal and support between the manhole cover and the sewer catch basin.

A further embodiment of the present invention is illustrated in FIG. 3, wherein the expanding means is comprised of an expandable cylindrical ring or collar 15, which is placed within the interior of the manhole frame 2 and the opening in the sewer catch basin 4. The expandable ring or collar 15 is then expanded to engage the interior surfaces of the manhole frame 2 and the sewer catch basin 4. The concrete is then poured around the expandable ring or collar 15, the manhole frame 2 and the sewer catch basin 4 in the same manner as is done with the inflatable enpanding ring, or inner tube 14, as described hereinabove. The use of the expandable ring or collar 15, results in a smooth surface and water tight seal between the manhole frame 2 and the top surface of the sewer catch basin 4.

As can be seen from viewing the FIGS. and reading the description of the preferred embodiments of the subject invention, the process according to the present invention greatly decreases the time required to raise a manhole, and is many times faster then the conventional brick and mortar process. Accordingly, traffic flow is back to normal, resulting in fewer problems. An additional advantage is noted the next time the manhole frame must be adjusted or raised for a street repaving operation. The process according to the present invention provides an entremely level base surface from which the casting is easily removed and on which the subject process can be repeated with ease.

What is claimed is:

1. A process for supporting a manhole frame and obtaining a seal between a manhole frame and a sewer catch basin, comprising the steps of:

a. positioning a manhole frame in a desired position relative to an opening in a sewer catch basin;

b. placing a flexible, resilient, air tight expandable means within the interior opening of the manhole frame and catch basin opening against the inner surfaces of said manhole frame and said sewer catch basin opening;

c. inflating said expandable means to expand said expandable means into contact with the inner surfaces of said manhole frame and said sewer catch basin opening d. placing sealing and supporting material around the exterior of said expandable means in sealing and supporting contact with said manhole frame and said sewer catch basin; and, e. removing said expandable means from the interior of said sealing and supporting material, said manhole frame, and said sewer catch basin.

* * * * *